US008256176B2

(12) United States Patent
Kuo

(10) Patent No.: US 8,256,176 B2
(45) Date of Patent: Sep. 4, 2012

(54) SUPPORT FRAME OF GLASS BRICK WALL AND METHOD FOR MOUNTING THE SAME

(76) Inventor: Yuan-Lun Kuo, Taipei (TW)

( * ) Notice: Subject to any disclaimer, the term of this patent is extended or adjusted under 35 U.S.C. 154(b) by 63 days.

(21) Appl. No.: 12/954,367

(22) Filed: Nov. 24, 2010

(65) Prior Publication Data

US 2012/0124926 A1 May 24, 2012

(51) Int. Cl.
*E04C 1/42* (2006.01)

(52) U.S. Cl. ..... 52/308; 52/28; 362/432

(58) Field of Classification Search ..... 52/306–308, 52/28; 362/147, 404, 418, 419, 432, 457
See application file for complete search history.

(56) References Cited

U.S. PATENT DOCUMENTS

| | | | | |
|---|---|---|---|---|
| 5,031,372 | A | 7/1991 | McCluer | |
| 5,321,593 | A * | 6/1994 | Moates | 362/249.05 |
| 5,337,225 | A * | 8/1994 | Brookman | 362/145 |
| 5,430,985 | A * | 7/1995 | Coleman | 52/308 |
| 5,806,263 | A * | 9/1998 | Coleman | 52/306 |
| 6,739,735 | B2 * | 5/2004 | Meyer et al. | 362/237 |
| 7,021,786 | B1 * | 4/2006 | Sandor, Sr. | 362/153 |
| 7,549,784 | B1 * | 6/2009 | Teeters | 362/576 |
| 7,587,870 | B2 * | 9/2009 | Voegele et al. | 52/308 |
| 7,621,086 | B2 * | 11/2009 | Voegele et al. | 52/308 |
| 7,753,577 | B2 * | 7/2010 | Teeters | 362/576 |
| 7,877,947 | B2 * | 2/2011 | Borressen et al. | 52/306 |
| 2004/0177577 | A1 | 9/2004 | Voegele et al. | |
| 2008/0198584 | A1 * | 8/2008 | Fouraux et al. | 362/147 |

FOREIGN PATENT DOCUMENTS

| | | | |
|---|---|---|---|
| DE | 10335633 | A1 | 3/2005 |
| DE | 202007002170 | U1 | 7/2007 |
| EP | 1508653 | | 2/2005 |
| GB | 2398085 | A | 8/2004 |
| TW | 200936853 | | 9/2009 |
| WO | 97/29251 | A1 | 8/1997 |

* cited by examiner

*Primary Examiner* — Robert Canfield
*Assistant Examiner* — Brent W Herring
(74) *Attorney, Agent, or Firm* — Rahman LLC

(57) ABSTRACT

A support frame of glass brick wall has multiple horizontal beams, multiple vertical beams and multiple side bars. Each of the horizontal beams and the vertical beams has a body, two side wings respectively and longitudinally formed on and protruding from two edges of the body, and two lamp slots respectively and longitudinally formed on and recessed from two sides of the body. Each of the vertical beams is securely mounted between two adjacent glass bricks in a corresponding row of glass bricks with adhesive. Each of the horizontal beams is securely mounted on a top of a corresponding row of glass bricks with adhesive. Two of the side bars are securely mounted on two edge sides of the glass brick wall. Each of the side bars has openings to replace light strips mounted in the lamp slots. Accordingly, the support frame provides a clean and easy lamp replacement solution.

15 Claims, 5 Drawing Sheets

SUPPORT FRAME OF GLASS BRICK WALL AND METHOD FOR MOUNTING THE SAME

BACKGROUND OF THE INVENTION

1. Field of the Invention

The present invention relates to a support frame of a glass brick wall, and more particularly to a support frame assembled with a glass brick wall and having a lighting source mounted in the support frame and to be conveniently replaced.

2. Description of the Related Art

Glass brick walls are transparent, composed of cubical glass bricks and are mostly employed in interior design for enhancing aesthetic appeal and diversifying indoor layout arrangements.

To be piled up, conventional glass bricks of a glass brick wall usually have gaps formed between each other so that steel bars can be respectively mounted in the gaps among the glass bricks to serve as a support frame of the entire glass brick wall. Cement is then filled into the gaps just as in the regular brick wall construction.

However, as glass brick walls are mostly built indoors, cement must be placed on an empty floor in the nearby and be mixed on the spot indoors during the course of construction. Dust and slurry resulting from mixing cement certainly messes up the indoor environment, and cleaning up the hardened plaster becomes another problem. Homeowners also need to hire a constructor to work on the glass brick wall on their properties and hence have to afford an additional expenditure for that. Moreover, to firmly bond the glass brick wall with cement, a gap reserved between each two adjacent glass bricks should be wide enough to form a thick cement layer of the adjacent glass bricks. The thick cement layers formed inside the glass brick wall indeed dramatically reduce the aesthetic appeal of the entire glass brick wall as an indoor landscape.

Additionally, when an indoor landscape is created with the glass brick wall, light sources are mounted on the wall to project light through the glass bricks so as to decorate the landscape by producing the misty lighting effect. However, the light sources not only occupy space but also require sufficient luminance to maintain a desired decorating and lighting effect.

SUMMARY OF THE INVENTION

An objective of the present invention is to provide a support frame assembled with a glass brick wall and having lighting sources mounted in the support frame to be conveniently replaced.

To achieve the foregoing objective, the support frame has multiple horizontal beams and multiple vertical beams. Each of the horizontal beams and the vertical beams has a body, two side wings, two lamp slots, two cover strips and a pin hole.

The body is elongated and flat, is adapted to have a width corresponding to those of four edge sides of a glass brick of a glass brick wall, and has a top, a bottom, two opposite sides and two opposite ends.

The side wings are respectively and longitudinally formed on and protrude from two edges of the body, and are adapted to be respectively placed on two edges of one of the edge sides of a corresponding glass brick.

The lamp slots are elongated and respectively and longitudinally formed on and recessed from the top and the bottom of the body, are formed through the ends of the body, and has two opposite sidewalls.

The cover strips are transparent. Each of the cover strips is mounted in the sidewalls of a corresponding lamp slot.

The pin hole is formed through the ends of the body.

Preferably, the support frame further has a first side bar and a second side bar, and each of the first side bar and the second side bar has a tubular body and a replacement cover. The tubular body has multiple first openings, multiple second openings and multiple second through holes. The first openings are formed through one side of the tubular body facing the lamp slots of the horizontal beams and are arranged in at least one column respectively aligning with corresponding lamp slots of the horizontal beams. The second openings are formed through another side of the tubular body adjacent to the side having the first openings and are respectively adjacent to the first openings. The second through holes are formed through the side of the tubular body having the first openings and respectively aligning with the pin holes of the horizontal beams. The replacement cover is movably covered on the side of the tubular body having the second openings.

Preferably, the support frame further has a third side bar and at least one lamp strip, and each of the at least one lamp strip is flexible and movably mounted in or removed from a corresponding lamp slot and has multiple LEDs mounted thereon.

The support frame employs the horizontal beams, the vertical beams and the side bar to bind and support glass bricks. Assembling the glass brick wall with the support frame will not mess up the environment. The mounting method of the support frame is simple, and thus, the support frame can be assembled with glass bricks to form a glass brick wall in a do-it-yourself (DIY) fashion. When a lamp strip is faulty, the faulty lamp strip can be easily replaced through the side bar. Accordingly, the support frame achieves a solution to keep the mounting environment clean and tidy during mounting, while saving extra cost for hiring workers to do the mounting and making replacement of light sources inside the glass brick wall easy and convenient.

Other objectives, advantages and novel features of the invention will become more apparent from the following detailed description when taken in conjunction with the accompanying drawings.

DETAILED DESCRIPTION OF THE INVENTION

Figure 1:
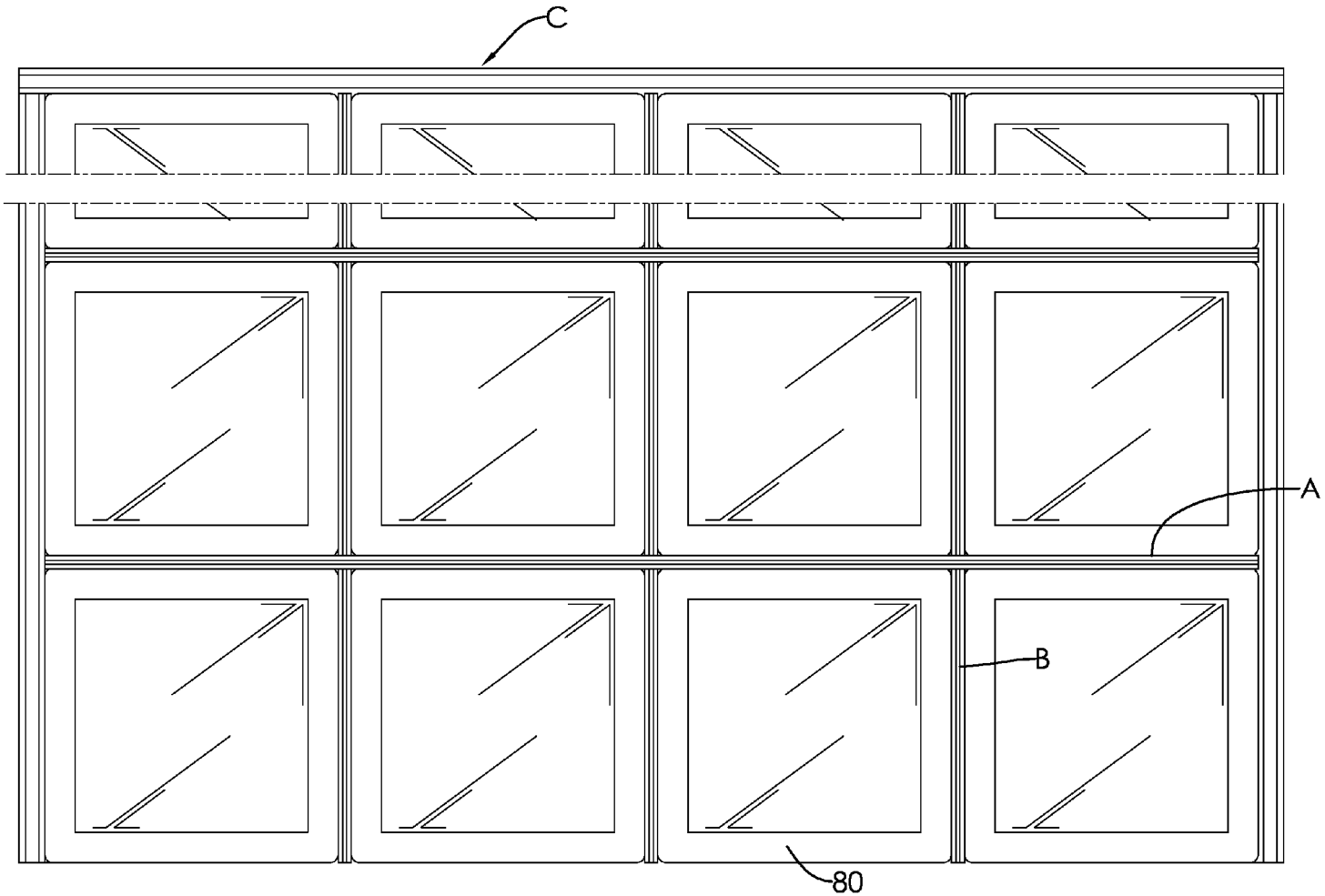
FIG. 1 is a front view of a glass brick wall having a support frame in accordance with the present invention.

With reference to FIG. 1, a first embodiment of a support frame of glass brick wall in accordance with the present invention has multiple horizontal beams (A), multiple vertical beams (B) and multiple side bars (C).

Figure 2:
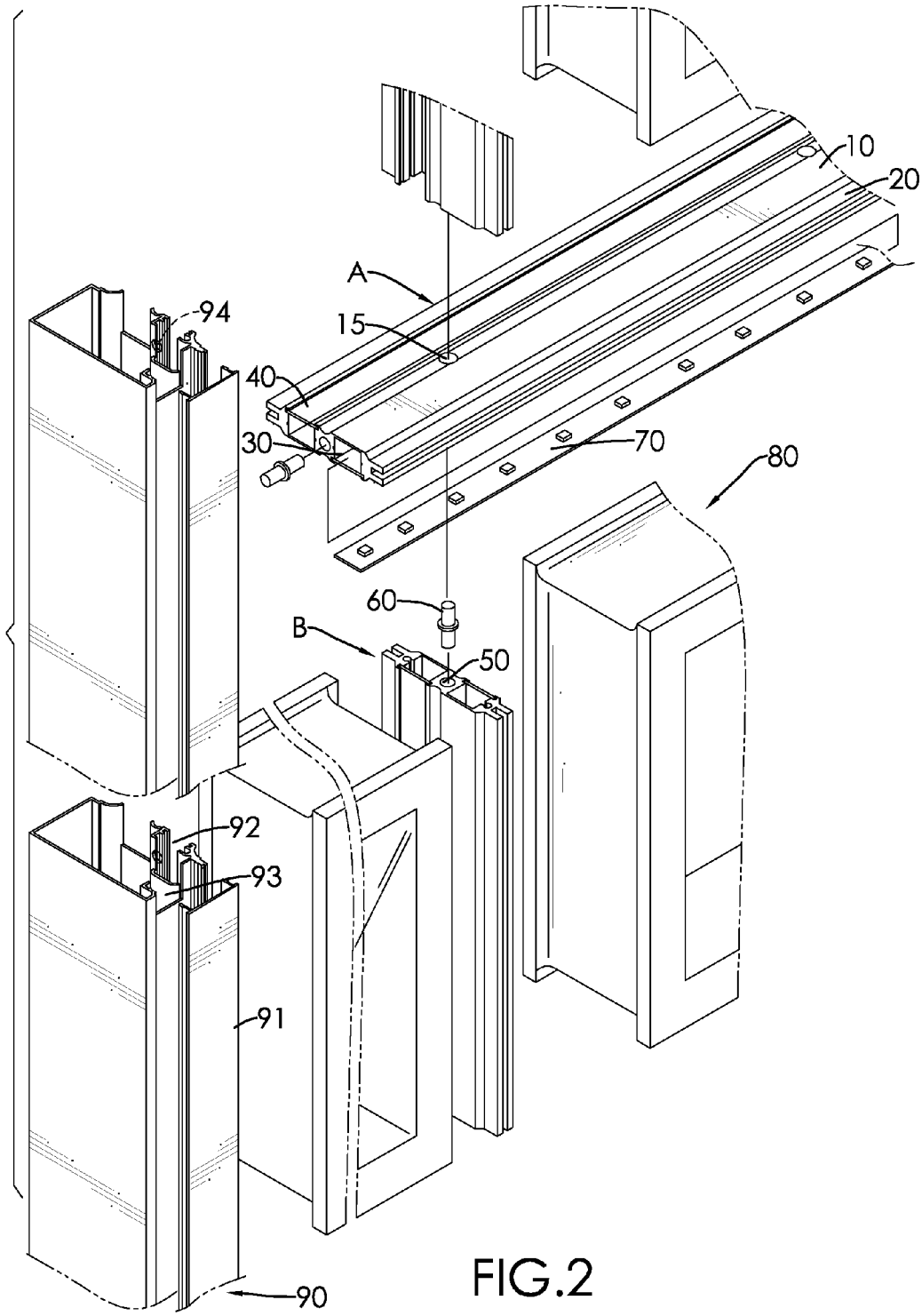
FIG. 2 is an enlarged exploded perspective view of a first embodiment of the support frame in FIG. 1.
Figure 3:
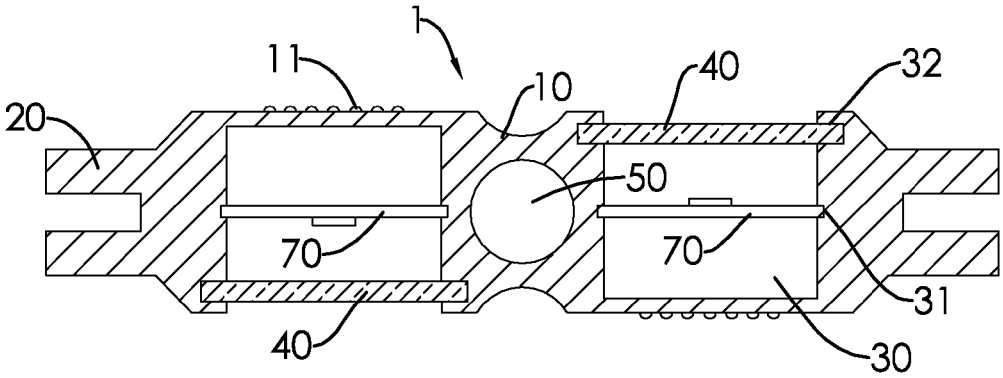
FIG. 3 is a side view in partial section of a horizontal beam or vertical beam of the support frame in FIG. 2.

The horizontal beams (A) and the vertical beams (B) are perpendicularly mounted to support glass bricks framed by the horizontal beams (A) and the vertical beams (B). The horizontal beam (A) is exactly the same as the vertical beam (B), but the horizontal and vertical beams (A, B) may differ in length depending on the numbers of rows of glass bricks and columns of glass bricks required for a glass brick wall. With reference to FIGS. 2 to 3, each of the horizontal beam (A) and the vertical beam (B) has a body 10, two side wings 20, two lamp slots 30, two cover strips 40, a pin hole 50, a pin 60, at least one lamp strip 70 and multiple first through holes 15.

The body 10 is elongated and flat, and has a width corresponding to that of one of four edge sides of a glass brick 80. The body 10 further has two corrugated surfaces 11 respectively formed on and protruding from a top and a bottom of the body 10 and longitudinally extending between two ends of the body 10 for increasing friction when in contact with the glass brick 80. Each of the corrugated surfaces 11 may take a form of multiple parallel ridges.

Figure 4:
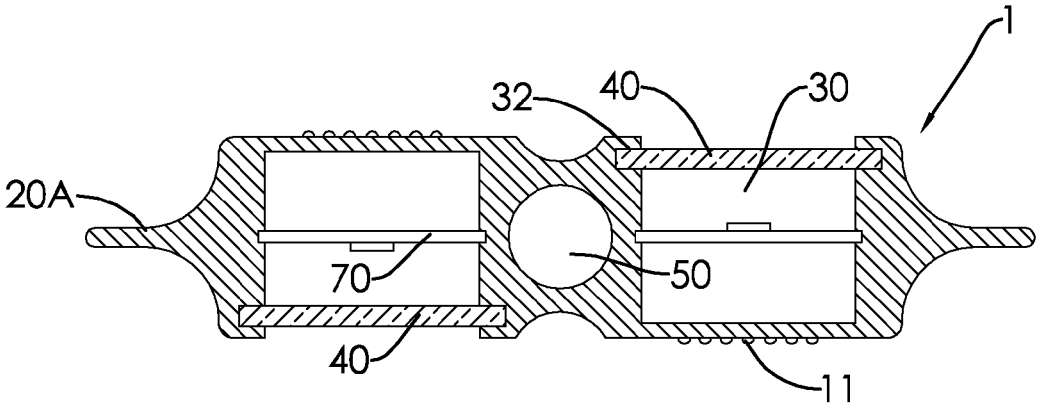
FIG. 4 is a side view in partial section of a horizontal beam or vertical beam of a second embodiment of the support frame in FIG. 1.

The side wings 20 are respectively and longitudinally formed on and protrude from two longitudinal sides of the body 10, and are respectively placed on two edges of one of the edge sides of the glass brick 80 to prevent two adjacent glass bricks 80 from abutting against each other. Each of the side wings 20 takes a form of two parallel fins spaced each other. With reference to FIG. 4, each of the side wings 20A takes a form of a single fin. The thinner form of the side wings 20A allows adjacent glass bricks to be assembled with smaller gaps therebetween.

The lamp slots 30 are elongated, and are respectively and longitudinally formed in and recessed from the top and the bottom and the body 10, and are formed through two ends of the body 10. Each of the lamp slots 30 has two lamp channels 31 and two cover channels 32. The lamp channels 31 are respectively and longitudinally formed in two sidewalls of the lamp slot 30. The two cover channels 32 are respectively and longitudinally formed in the two sidewalls and are adjacent to an opening of the lamp slot 30.

Two cover strips 40 are transparent, and each of the cover strips 40 is mounted in the two cover channels 32 of a corresponding lamp slot 30. The pin hole 50 is formed through the two ends of the body 10. One end of the pin 60 is mounted in the pin hole 50. Each one of the at least one lamp strip 70 is flexible and movably mounted in or removed from the lamp channels 31 of a corresponding lamp slot 30, and has multiple LEDs mounted on the lamp strip 70. The at least one lamp strip 70 is optional and may be absent from the horizontal beam (A) or the vertical beam (B). The first through holes 15 are formed through the body 10 and spaced with a distance equivalent to a sum of a length of a glass brick 80 and a thickness of the body 10 of the horizontal beam (A) or the vertical beam (B).

Each of the side bars (C) serves to hold one side of the glass brick wall to prevent the glass brick wall from collapsing and facilitates replacement of the lamp strips 70 respectively mounted inside the lamp slots 30 of the horizontal beam (A) or the vertical beam (B). When no lamp strip 70 is mounted inside the vertical beams (B) of the glass brick wall, the support frame has two side bars (C). One side bar (C) is mounted between one wall and a vertical side of the glass brick wall. The other side bar (C) is mounted between the other opposite vertical side of the glass brick wall and the wall or on the other opposite vertical side of the glass brick wall only. When lamp strips 70 are mounted inside the vertical beams (B) of the glass brick wall, the support frame has three side bars (C). Two side bars (C) are mounted in a similar way as those of the support frame having no lamp strip 70 in the vertical beams (B). The additional side bar (C) is mounted on a top of the glass brick wall. Each of the side bars (C) has a length equivalent to a height or a length of the glass brick wall, and has a tubular body 90 and a replacement cover 91. The tubular body 90 has a square hollow section, and has multiple first openings 92, multiple second openings 93 and multiple second through holes 94. The first openings 92 and the second openings 93 serve for replacement of the lamp strips 70. The first openings 92 are formed through one side of the tubular body 90 facing the lamp slots 30 and arranged in at least one column. The first openings 92 that are arranged in one of the at least one column respectively align with the lamp slots 30 of the horizontal beams (A). In the present embodiment, the first openings 92 are arranged in one column. The second openings 93 are formed through another side of the tubular body 90 adjacent to the side having the first openings 92, and are respectively adjacent to the first openings 92. The replacement cover 91 is detachably covered on the side of the tubular body 90 having the second openings 93. The second through holes 94 are formed through the side of the tubular body 90 having the first openings 92 and respectively align with the pin holes of the horizontal beams (A).

Figure 5:
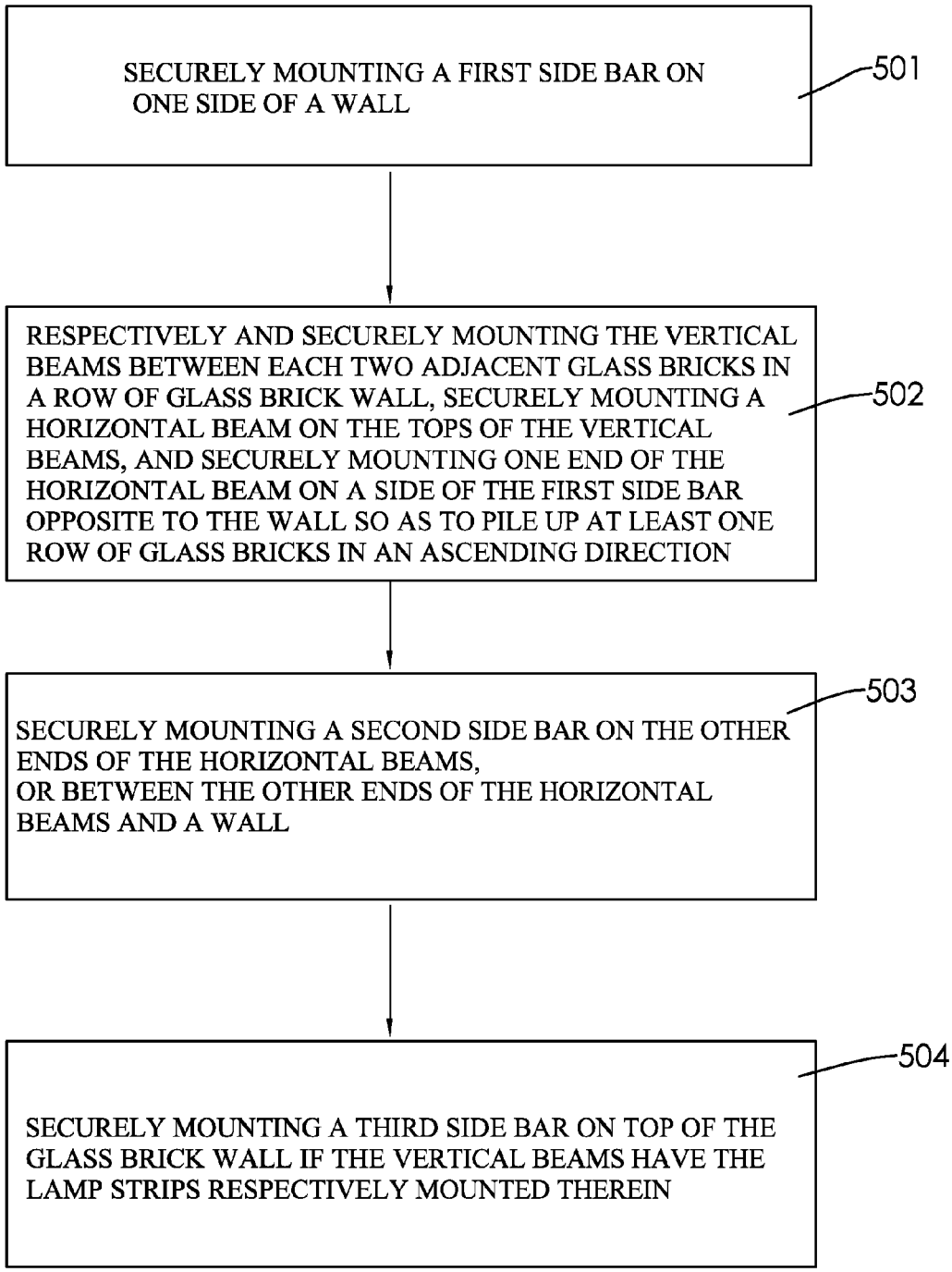
FIG. 5 is a block diagram of a method of mounting the support frame in accordance with the present invention.

When mounting a glass brick wall, a length of each of the vertical beams (B) is equal to a height of the glass brick 80, length of one of the horizontal beams (A) is equal to a sum of the lengths of the glass bricks 80 in a corresponding row of the glass brick wall, and the height of the side bars (C) is equal to that of the glass brick wall. With reference to FIG. 5, a method for mounting the support frame of glass brick wall has the following steps of:

Securely mounting a first side bar (C) on one side of a wall 501. One side bar (C) is bonded on a wall, and the side of the first side bar (C) having the first openings 92 is opposite to the wall.

Respectively and securely mounting the vertical beams (B) between each two adjacent glass bricks 80 in a row of glass brick wall, securely mounting a horizontal beam (A) on the tops of the vertical beams (B), and securely mounting one end of the horizontal beam (A) on a side of the first side bar (C) opposite to the wall so as to pile up at least one row of glass bricks in an ascending direction 502. The glass bricks 80 in the bottom row of the glass brick wall are mounted first. Each vertical beam (B) in the bottom row of the glass brick wall is squeezed by and bonded with two adjacent glass bricks 80 in the bottom row with adhesive. One end of the pin 60 is mounted in the pin hole 50 in one end of each of the vertical beams (B) in the bottom row. A horizontal beam (A) is directly placed on a top of the bottom row of the glass brick wall, and the first through holes 15 of the horizontal beam (A) respectively align with and are respectively mounted around the other ends of the pins 60 in the pin holes 50 of the vertical beams (B), so that the horizontal beam (A) can be bonded with the top of the bottom row of the glass brick wall with adhesive. One pin 60 is mounted in the pin hole 50 on one side of the horizontal beam (A) and a corresponding second through hole of the first side bar (C), so that one end of the horizontal beam (A) having the pin 60 and an outermost glass brick adjacent to the first side bar (C) can be bonded with the side of the first side bar (C) having the second through holes 94. After the bottom row of glass brick wall is completed, one pin 60 is mounted through each of the first through holes 15 of the horizontal beam (A). A second row atop the bottom row of glass brick wall is mounted by repeating the foregoing process except that the pin holes 50 of the vertical beams (B) of the second row are respectively sleeved around the pins 60 respectively mounted through the first through holes 15 of the horizontal beam (A) of the bottom row. More rows atop the second row of the glass brick wall are mounted by following the same procedures for assembling the second row. Wherein, the step 502 may be omitted to mount the vertical beams (B), horizontal beams (A) together with glass bricks 80 when a low glass brick wall is being built.

Securely mounting a second side bar (C) on the other ends of the horizontal beams (A), or between the other ends of the horizontal beams (A) and a wall 503. After all rows of glass bricks 80 are mounted, one end of a pin 60 is mounted in the pin hole 50 on the other side of the horizontal beam (A) and the other end of the pin 60 is mounted in a corresponding second through hole 94 of the second side bar (C), so that the side of the second side bar (C) having the second through holes 94 can be bonded with the other ends of the horizontal beams (A) and the column of glass bricks 80 adjacent to the second side bar (C). For further reinforcing the glass brick wall, the second side bar (C) may be mounted between the other ends of the horizontal beams (A) and a wall; and Securely mounting a third side bar (C) on top of the glass brick wall if the vertical beams (B) have the lamp strips 70 respectively mounted therein 504. One pin 60 is mounted in the pin hole 50 on the other end of each of the vertical beams (B) and a corresponding second through hole 94 of the third side bar (C), so that the side of the third side bar (C) having the second through holes 94 can be bonded with the other ends of the vertical beams (B) and the top row of glass bricks 80 adjacent to the third side bar (C). After the third side bar (C) on the top of the glass brick wall is mounted, the mounting process of the entire glass brick wall is completed.

Figure 6:
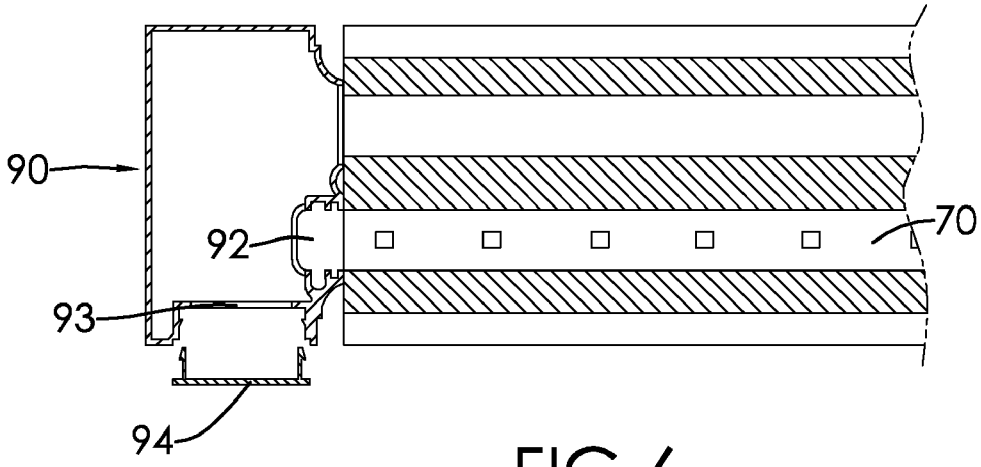
FIG. 6 is an operational top view in partial section of the support frame in FIG. 2.
Figure 7:
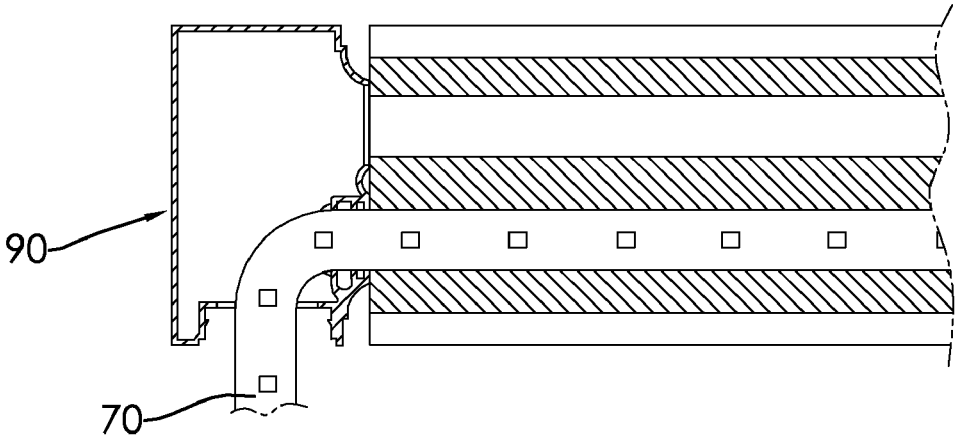
FIG. 7 is another operational top view in partial section of the support frame in FIG. 2.

With reference to FIGS. 6 and 7, when a lamp strip 70 is faulty and is located in a corresponding lamp slot 20 of a horizontal beam (A), the faulty lamp strip 70 can be replaced by detaching the replacement cover 91 from a corresponding side bar (C), reaching the faulty lamp strip 70 sequentially through the corresponding second opening 93 and first opening 92, removing the faulty lamp strip 70 out of the lamp channels 31 of a corresponding lamp slot 30 through the first opening 92 and the second opening 93, slidably mounting a new lamp strip 70 back in the lamp channels 31 of the lamp slot 30, and covering the replacement cover 91.

As the support frame is assembled with the glass bricks 80 by pins 60 and pin holes 50 and adhesive, no cement is required for bonding the glass brick wall. Hence, the indoor environment is not made messy by mixing cement and applying cement among the glass bricks 80. The glass bricks 50 are partitioned by the side wings 20, 20A, and the gaps between the glass bricks 80 can be practically maintained as thin as 2 mm, thereby effectively reducing the gaps and increasing the aesthetic appeal of the glass brick wall. Additionally, the method of assembling the support frame with the glass bricks 80 is simple and does not require cement. The replacement of lamp strip 70 is also straightforward. Accordingly, homeowners can purchase parts of the support frame and assemble the support frame with glass bricks by themselves to save an additional expenditure for mounting and maintaining the glass brick wall.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A support frame of a glass brick wall, said support frame comprising:

multiple horizontal beams, multiple vertical beams, a first side bar, and a second side bar, wherein each of the horizontal beams and the vertical beams having:

a body being elongated and flat, adapted to have a width corresponding to those of four edge sides of a glass brick of said glass brick wall, and having:

a top;

a bottom;

two opposite sides; and two opposite ends;

two side wings respectively and longitudinally formed on and protruding from two edges of the body, and adapted to be respectively placed on two edges of one of the edge sides of a corresponding glass brick;

two lamp slots elongated and respectively and longitudinally formed on and recessed from the top and the bottom of the body, formed through the ends of the body, and having two opposite sidewalls;

two cover strips being transparent, each of the cover strips mounted in the sidewalls of a corresponding lamp slot; and a pin hole formed through the ends of the body, wherein each of the first side bar and the second side bar comprise:

a tubular body having:

multiple first openings formed through one side of the tubular body facing the lamp slots of the horizontal beams and arranged in at least one column respectively aligning with corresponding lamp slots of the horizontal beams;

multiple second opening formed through another side of the tubular body adjacent to the side having the first openings and being respectively adjacent to the first openings; and multiple second through holes formed through the side of the tubular body having the first openings and respectively aligning with the pin holes of the horizontal beams; and a replacement cover detachably covered on the side of the tubular body having the second openings.

2. The support frame as claimed in claim 1, wherein each of the side wings takes a form of two parallel fins spaced apart from each other.

3. The support frame as claimed in claim 2, further comprising multiple first through holes longitudinally formed through the body and spaced with a distance adapted to be equal to a sum of a length of the glass brick and a thickness of the body.

4. The support frame as claimed in claim 3, wherein the body further has a corrugated surface taking a form of multiple parallel ridges, respectively formed on and protruding from a top and a bottom of the body, and longitudinally extending between the ends of the body.

5. The support frame as claimed in claim 4, further comprising a third side bar and at least one lamp strip, each one of the at least one lamp strip being flexible and movably mounted in or removed from a corresponding lamp slot, and having multiple LEDs mounted on the lamp strip.

6. The support frame as claimed in claim 1, wherein each of the side wings takes a form of a single fin.

7. The support frame as claimed in claim 6, further comprising multiple first through holes longitudinally formed through the body and spaced with a distance adapted to be equal to a sum of a length of the glass brick and a thickness of the body.

8. The support frame as claimed in claim 7, wherein the body further has a corrugated surface taking a form of multiple parallel ridges, respectively formed on and protruding from a top and a bottom of the body, and longitudinally extending between the ends of the body.

9. The support frame as claimed in claim 8, further comprising a third side bar and at least one lamp strip, each one of the at least one lamp strip being flexible and movably mounted in or removed from a corresponding lamp slot, and having multiple LEDs mounted on the lamp strip.

10. A support frame of a glass brick wall, said support frame comprising:

a plurality of horizontal beams and multiple vertical beams, wherein each of the horizontal beams and the vertical beams comprising a substantially elongated and flat body comprising a width corresponding to four edge sides of a glass brick of said glass brick wall, wherein said body comprising a top, a bottom, a plurality of opposite sides, a plurality of opposite ends, a pin hole formed through the plurality of opposite ends of said body, and a corrugated surface comprising multiple parallel ridges protruding from said top and said bottom of said body and longitudinally extending between said plurality of opposite ends of said body;

a plurality of side wings protruding from two edges of said body, and adapted to be respectively placed on two edges of one of the edge sides of a corresponding glass brick, wherein each of the side wings comprises a plurality of parallel fins spaced apart from each other;

a plurality of lamp slots formed on and recessed from said top and said bottom of said body, wherein said plurality of lamp slots are formed through said plurality of opposite ends of said body, and comprise a plurality of opposite sidewalls;

a plurality of substantially transparent cover strips, wherein each cover strip is mounted in the sidewalls of a corresponding lamp slot;

a plurality of first through holes formed through said body and spaced with a distance that is equal to a sum of a length of said glass brick and a thickness of said body;

a first side bar and a second side bar, wherein each of the first side bar and the second side bar comprising a tubular body comprising:

a plurality of first openings formed through a first side of said tubular body and arranged in at least one column respectively facing and aligning with corresponding lamp slots of said horizontal beams;

a plurality of second openings formed through a second side of said tubular body adjacent to a side comprising said plurality of first openings and being respectively adjacent to said plurality of first openings;

a plurality of second through holes formed through said side of said tubular body comprising said plurality of first openings and respectively aligning with pin holes of said horizontal beams; and a cover detachably connected on the side of said tubular body comprising said plurality of second openings.

11. The support frame as claimed in claim 10, further comprising a third side bar and at least one lamp strip, each one of said at least one lamp strip being flexible and movably mounted in a corresponding lamp slot, and having multiple LEDs mounted on said at least one lamp strip.

12. The support frame as claimed in claim 10, further comprising a third side bar and at least one lamp strip, wherein each one of said at least one lamp strip being flexible and adapted to be removed from a corresponding lamp slot, and having multiple LEDs mounted on said at least one lamp strip.

13. A support frame of a glass brick wall, said support frame comprising:

a plurality of horizontal beams and multiple vertical beams, wherein each of the horizontal beams and the vertical beams comprising a substantially elongated and flat body comprising a width corresponding to four edge sides of a glass brick of said glass brick wall, wherein said body comprising a top, a bottom, a plurality of opposite sides, a plurality of opposite ends, a pin hole formed through the plurality of opposite ends of said body, and a corrugated surface comprising multiple parallel ridges protruding from said top and said bottom of said body and longitudinally extending between said plurality of opposite ends of said body;

a plurality of side wings protruding from two edges of said body, and adapted to be respectively placed on two edges of one of the edge sides of a corresponding glass brick, wherein each of said plurality of side wings comprises a fin;

a plurality of lamp slots formed on and recessed from said top and said bottom of said body, wherein said plurality of lamp slots are formed through said plurality of opposite ends of said body, and comprise a plurality of opposite sidewalls;

a plurality of substantially transparent cover strips, wherein each cover strip is mounted in the sidewalls of a corresponding lamp slot;

a plurality of first through holes formed through said body and spaced with a distance that is equal to a sum of a length of said glass brick and a thickness of said body;

a first side bar and a second side bar, wherein each of the first side bar and the second side bar comprising a tubular body comprising:

a plurality of first openings formed through a first side of said tubular body and arranged in at least one column respectively facing and aligning with corresponding lamp slots of said horizontal beams;

a plurality of second openings formed through a second side of said tubular body adjacent to a side comprising said plurality of first openings and being respectively adjacent to said plurality of first openings;

a plurality of second through holes formed through said side of said tubular body comprising said plurality of first openings and respectively aligning with pin holes of said horizontal beams; and a cover detachably connected on the side of said tubular body comprising said plurality of second openings.

14. The support frame as claimed in claim 13, further comprising a third side bar and at least one lamp strip, each one of said at least one lamp strip being flexible and movably mounted in a corresponding lamp slot, and having multiple LEDs mounted on said at least one lamp strip.

15. The support frame as claimed in claim 13, further comprising a third side bar and at least one lamp strip, wherein each one of said at least one lamp strip being flexible and adapted to be removed from a corresponding lamp slot, and having multiple LEDs mounted on said at least one lamp strip.

* * * * *